United States Patent [19]

Radwanski et al.

[11] Patent Number: 4,767,586

[45] Date of Patent: Aug. 30, 1988

[54] APPARATUS AND METHOD FOR FORMING A MULTICOMPONENT INTEGRAL LAID FIBROUS WEB WITH DISCRETE HOMOGENEOUS COMPOSITIONAL ZONES, AND FIBROUS WEB PRODUCED THEREBY

[75] Inventors: Fred R. Radwanski, Norcross; Raymond Chung, Roswell, both of Ga.

[73] Assignee: Kimberly-Clark Corporation, Neenah, Wis.

[21] Appl. No.: 818,440

[22] Filed: Jan. 13, 1986

[51] Int. Cl.[4] ..... D04H 1/04

[52] U.S. Cl. ..... 264/113; 264/112; 264/115; 264/121; 264/518; 425/81.1; 425/82.1; 425/83.1

[58] Field of Search ..... 264/517, 518, 121, 122, 264/115, 116, 112, 113; 425/81.1, 82.1, 83.1; 428/284, 296, 420

[56] References Cited

U.S. PATENT DOCUMENTS

| | | | |
|---|---|---|---|
| 2,624,079 | 1/1953 | Duvall | 19/155 |
| 2,751,962 | 6/1956 | Drummond | 154/1.7 |
| 2,998,051 | 8/1961 | Sittel | 154/1.7 |
| 3,128,507 | 4/1964 | Pearson | 19/155 |
| 3,753,271 | 8/1973 | McBean | 19/156.3 |
| 3,781,150 | 12/1973 | Matsumura et al. | 425/80 |
| 3,844,751 | 10/1974 | Stewart | 264/121 X |
| 3,848,598 | 11/1974 | Mesek | 128/287 |
| 3,857,657 | 12/1974 | Teed | 425/80 |
| 3,863,296 | 2/1975 | Buell | 264/518 |
| 3,943,605 | 3/1976 | Nystrand | 19/145 |
| 3,952,124 | 4/1976 | Mesek | 428/218 |
| 3,963,392 | 6/1976 | Goyal | 425/83 |
| 3,975,222 | 8/1976 | Mesek | 156/62.2 |
| 3,994,047 | 11/1976 | Lee et al. | 19/156.3 |
| 4,018,646 | 4/1977 | Ruffo et al. | 162/146 |
| 4,268,340 | 5/1981 | Fitzgerald et al. | 156/296 |

FOREIGN PATENT DOCUMENTS 2521602 8/1983 France .

*Primary Examiner*—Jan H. Silbaugh
*Assistant Examiner*—Mary Lynn Fertig
*Attorney, Agent, or Firm*—Paul Yee

[57] ABSTRACT

Apparatus and method for forming an integral laid fibrous web from multiple fiberizable components, characterized by generally discrete homogeneous compositional zones therein. The system comprises a housing having in its outer surface (i) inlet slot(s) for introduction of fiberizable materials into the housing and (ii) a discharge slot generally laterally coextensive with and translationally spaced from the inlet slot(s), for discharge of fiberized materials from the housing. A translatable body is positioned in the housing for translation therein, having a plurality of blades on its outer surface. The outer surface of the translatable body and the housing have a space therebetween wherein the blades travel during translation of the translatable body. First and second fiberizable components are fed to inlet slot(s) wherein the respective fiberizable components are at least partially laterally isolate relative to each other during the feeding. A translatable foraminous forming surface is positioned for receipt of the fiberized materials discharged from the housing through the discharge slot during translation of the forming surface, whereby the discharge fiberized components are laid on the forming surface in generally discrete homogeneous compositional zones of an integral laid fibrous web.

26 Claims, 3 Drawing Sheets

APPARATUS AND METHOD FOR FORMING A MULTICOMPONENT INTEGRAL LAID FIBROUS WEB WITH DISCRETE HOMOGENEOUS COMPOSITIONAL ZONES, AND FIBROUS WEB PRODUCED THEREBY

BACKGROUND OF THE INVENTION

1. Field of the Invention

This invention generally relates to apparatus and method for forming an integral laid fibrous web from multiple fiberizable components, and to articles produced thereby. More specifically the invention relates to apparatus and method of such type for forming an integral laid fibrous web with generally discrete, homogeneous compositional zones therein, and to the article formed thereby having laterally extending contiguous zones of different composition.

2. Description of the Prior Art

In the general practice of forming nonwoven fibrous webs, the source material in the form of a fibrous sheet such as pulp sheet, or other fiberizable feed source, is introduced to a fiberizer, wherein the fiber source material is disintegrated, shredded, fiberized or otherwise separated to produce a product material in the form of discrete, individual fibers. The product fibers then are suitably conveyed, for example, by gravity flow, or more commonly, by air-entrainment in a flow stream, onto a foraminous forming surface which may, for example, comprise a wire or screen, e.g., a Fourdrinier wire. The forming surface is translated, or otherwise moved, such as by means of an endless conveyor belt assembly, during the deposition of fibers, to yield the laid fibrous web. The fibrous web article produced thereby has utility in numerous absorbent article applications, such as sanitary napkins and disposable diapers.

In various absorbent article applications, it is desirable to provide a multicomponent fibrous web having discrete zones of different composition. For example, in the case of disposable diapers, it is desirable in some instances to provide a higher basis weight of absorbent material in selected areas of the diaper, and accordingly, it has been common practice to superimpose sequential layers of material in such areas to provide increased thickness and higher absorbency. Further, in forming nonwoven webs of cellulosic fibers, such as in papermaking, it sometimes is desirable to provide different compositional zones in selected products to accomodate different associated treatment steps. For example, different pore size gradients may be formed on different portions of a sheet, or one section of the sheet may be embossed and another section printed.

In many such instances where it is desired to provide a nonwoven fibrous web with multiple discrete compositional zones, it is advantageous for reasons of structural integrity, or ease of manufacture or use, to provide the web as an integral laid structure, as opposed to providing constructions wherein discrete individual layers are superimposed or adhesively bonded to one another. The prior art has proposed various apparatus and methods for producing integral laid fibrous webs with different compositional zones ktherein, but such zones characteristically have been in thickness layers, as opposed to laterally adjacent zones of different composition. In those instances where the prior art has proposed means for forming an integral laid fibrous web with laterally varying composition, the compsitional zones are not discrete and homogeneous in form, but rather the composition varies, linearly or otherwise, across the surface of the web. It, therefore, would be a significant advance in the art to provide an integral laid fibrous web from multiple fiberizable components, which is characterized by generally discrete homogeneous compositional zones in the sheet, wherein the compositional zones are laterally contiguous to one another and have a substantially homogeneous composition throughout the thickness of the web associated with each such zone.

U.S. Pat. Nos. 3,848,589 and 3,975,222 to F. K. Mesek describe the production of an air-laid web by simultaneously feeding to an individualizing station (fiberizer) two continuous strips of compacted fibers, one strip being narrower than and lying along the longitudinal median of the other, with the individualized fibers then being deposited on a moving foraminous belt from an airstream. Longitudinal peaks are provided in the air-laid web by varying the rate of feed of the continuous strips to the individualizing station, to provide a web panel which is double contoured, i.e., centrally contoured in the transverse and longitudinal directions to produce a smooth peak on one major surface. The patent states at column 8, lines 3–10 that alternatively, such longitudinal contour may be imparted to the web by varying the speed of the laydown surface or by grinding fibers at one station to produce a continuous web with a transverse contour and then sequentially grinding selecting amounts of fibers at another station which are deposited on the continuous web to produce repetitive longitudinal contours.

U.S. Pat. No. 3,994,047 to C. A. Lee, et al., discloses the formation of a composite pad from fibers air-laid on a twin-wire machine. A pair of endless foraminous carriers are passed through a forming chamber wherein air-entrained fibers are directed between the carriers, to build up a web structure on each of such carriers. Each of the forming wires has a discrete flow section defining the associated layer of the composite, and the respective carriers converge to join the facing surfaces of the respective web layers to form the composite having a non-uniform cross-section. The formed article illustratively disclosed in the patent is a pad suitable for use in applications such as disposable diapers, comprising a first layer of hourglass shape, and a second layer of ovate shape, which is superimposed on the first layer to provide an increased absorptivity region for the composite article. The patent discloses the provision of fibers from divellicated webs of felted wood pulp, with the fiber source for each of the respective layers of the pad being of the same composition.

French Pat. No. 2,521,602 to Societe Dite Etablissements Ruby, discloses an apparatus for concurrently forming two or more continuous fibrous webs requiring different feed rates. Multiple lay-up drums are coaxially mounted in side-by-side relationship, but driven via speed reduction couplings from the same drive motor at differing speeds. The apparatus is stated to be useful for preparation of complementary layers of composite absorbent fabrics for application such as sanitary pads, diaper linings, etc., having layers of differing compaction. As shown in the drawings of this patent, a compressed layer is supplied at the same output rate as an uncompressed layer for continuous subsequent superposition of the respective layers to produce a composite fabric.

U.S. Pat. No. 3,857,657 to R. K. Teed discloses an apparatus for forming a laid fibrous web in the form of discrete spaced-apart pads on a foraminous forming surface. A wet-pressed pulp fiber sheet is fed into a stationary housing forming a generally enclosed chamber open at its bottom portion, through a slot in the housing. In the housing is mounted a fiberizing device comprising a generally cylindrically-shaped roll having teeth around its outer circumference. The cylindrical roll may be in the form of a plurality of cylindrical disks mounted in side-by-side relationship on a common support shaft, with teeth around the outer periphery or circumference of each of the constituent disks. The resulting discrete fibers travel from the upper portion of the housing onto the forming surface which is in the form of an endless conveyor belt comprising sequential spaced-apart arrays of openings, corresponding to the shape and size of the laid web product. A vacuum suction arrangement acts to impose vacuum suction on the forming surface to cause fiber deposition on the perforated portions thereof. Gas flow conduits are disposed at opposite ends of the forming surface as presented to the fiberizer, and a motor driven fan creates a positive airstream through the region above the forming surface, in turbulent flow, to cause the fiberized fibers to settle only on the perforated portions of the forming surface and to pick up and remove fiberized fibers settling in spaces between the groups of perforations for recirculation to the pad forming area in the lower portion of the chamber defined by the housing. In the disclosed apparatus the longitudinal axis of the cylindrical roll in the housing is aligned parallel with respect to the center line (longitudinal axis) of the forming surface associated therewith, so that the fiber sheet if fed into the housing for fiberization therein, in a direction generally perpendicular to the direction of translation of the foraminous forming surface.

U.S. Pat. No. 3,963,392 to P. K. Goyal discloses an apparatus and method for forming a multicomponent integral laid fibrous web. The apparatus includes plural pairs of spaced parallel, oppositely rotating fiberizers (toothed cylinders), each pair having a movable divider plate therebetween. High speed air-streams flowing past each individual fiberizer entrain the fibers and carry same to a mixing zone between the respective fiberizers to form combined streams, which thereafter enter a common mixing zone above the forming surface, as a composite stream. The divider plates between each pair of fiberizers in this system are adjustable from a range of positions, from a completely withdrawn to a fully downwardly extending position, whereby the degree of intermixing of the entrained fibers in the combined streams may be controlled. A divider plate is also disposed in adjustable relationship with respect to the common mixing zone, to control the degree to which the combined streams intermix in forming a composite stream at the forming surface. The forming surface may define multiple laydown zones associated with individual suction sources which may be independently adjusted to further vary the web formed on the forming surface. The various fiberizer cylinders in this system are oriented with their cylindrical axes perpendicular to the direction of translation of the forming surface.

FIGS. 3–6 in this patent disclose a number of relative configurations of the various divider plates, whereby the web may be laid with sequential layers across its thickness. The patent also discloses at column 9, lines 39–49 that if a fiber collector were disposed immediately below a mixing zone associated with one pair of fiberizing cylinders, having two distinct components fed thereto on either side of the divider plate, but with the divider plate in a fully retracted position, the resulting web would have a concentration of fibers of one component at one face in excess of the overall concentration of such fibers in the web, with the opposite face of the web having a concentration of the other fibers in excess of the overall concentration of such other fibers in the web, i.e., with the concentration of the first-mentioned fibers gradually and generally linearly diminishing from the respective "enriched" face of the web to its opposite face.

The Goyal patent states that the configuration and density of teeth of the fiberizer cylinder may vary with the specific materials being fiberized. For fiberization of pulp board, the fiberizer cylinder teeth may have a pitch of about 3/32–½ inch, a tooth height of about 3/32–½ inch, and a tooth angle of about −10° to about +10°. For fiberization of rayon in the form of a carded batt, the corresponding values are about ⅛–¼ inch for tooth pitch, about ⅛–¼ inch for tooth height, and about −10° to about +20° for tooth angle. The pulp fiberizer is driven at a rotational speed of 6000 rpm and the rayon fiberizer is driven at 3000 rpm.

U.S. Pat. No. 3,943,605 to E. D. Nystrand discloses an apparatus and method for forming a composite fluff article wherein symmetrically arranged hammermills are fed by separate pulp web rolls, with the resulting fiberized streams being deposited on separate endless wire assemblies. One such laid fibrous layer is removed from its wire by suction and placed with its wire side engaging a wrap sheet traveling beneath the wire on which the second fluff layer is formed. The second layer is removed from its wire by applying suction from beneath, through the wrap sheet and the overlying first layer, to deposit the second layer on the first in inverted relation, i.e., with the respective top surfaces of the sheets as formed being abuttingly mated to form a composite sheet.

U.S. Pat. No. 2,624,079 to T. C. Duvall discloses a system for manufacture of air-laid felts wherein an endless conveyor is disposed beneath a series of deposition chambers. In each chamber a nozzle from a side wall discharges fibers by gravity in a trajectory which provides build-up of thickness of the web, followed by passage of the web through compression rolls to provide a high density, uniform thichness product. It is disclosed at column 5, lines 41–48 of this patent that the disclosed arrangement is flexible, and permits different kinds of materials or different forming conditions to exist in the several chambers, which may be employed in such a way as to build up a symmetrical composite mat which is continuous, but has sequential layers corresponding to the respective deposition chambers. FIG. 3 of this patent shows a composite integral web having outer layers of high grade material such as bleached sulfite fibers, the inner layers being of coarse or unbleached fiber material. It is further disclosed that a bank of injection devices (discharge nozzles) may be provided cross-wise of the web to be formed, i.e., transverse to the direction of translation of the forming surface.

U.S. Pat. No. 2,751,962 discloses a system for producing fibrous products wherein coarse and fine fibers are concurrently incorporated into an integral web. Specifically described is a system for laying of glass fibers from a for hearth of a furnace. A series of orifices in a flow communication with the forehearth receive molten or flowable fiber-forming material and under the influence of downwardly directed blasts of superheated stream of air impinging thereupon, the molten glass material is drawn or attenuated into fibers which pass downwardly for deposit on an upwardly canted endless belt forming surface. Concurrently, a side stream of the molten material is meltblown and directed in a horizontal direction, by hot high-velocity blasts of gases, onto the forming surface. The downwardly falling coarse and horizontally directed fine fibers intermix on the forming surface, to deposit as a homogeneous nonwoven mixture of the two. The patent discloses that the relatively coarse and relatively fine fiber materials may be different from one another. In another embodiment shown in the patent, in FIGS. 2–3 thereof, coarse fibers are formed in sequential air-blast orifice assemblies longitudinally spaced apart from one another in the direction of translation of the forming surface positioned therebeneath. The forming surface in this embodiment is horizontal; disposed intermediate the respective coarse fiber orifices as a transverse assembly of two restricted orifices associated with means for producing blasts of intensely hot gases therethrough, to form relatively fine fibers. Directly above the forming surface is a shroud which is in fluid flow communication with the orifices generating the respective coarse and fine fibers. The fine and coarse fibers intermingle and mix in the hood, with the mixing augmented by the turbulence of the moving gases therein. In both embodiments a homogeneous mixture of the coarse and fine particles is produced, consistent with the patentee's objective of concomitantly forming and comingling relatively fine and coarse fibers so that the fine fibers tend to pad or cushion the coarse fibers in a manner minimizing inter-abrasion of the fibers, and increasing the insulation value of the composite thereby formed.

U.S. Pat. No. 2,998,051 to K. Sittel discloses a system for forming fibrous articles in which fiber and resin particles are electrostatically combined to form a mat. The system comprises an electrically grounded rotating drum onto which the fiber particles and resin particles are electrostatically collected, with the forming surface disposed between the rotating drum and a pattern electrode disposed therebeneath. A corona electrode initially subjects the fiber particles to a negative electrostatic charge, whicle corona electrodes impose a positive electrostatic charge on the resin particles. The respective resin and fiber particles are then transferred electrostatically to endless conveyor belts from which a reciprocating trolley comprising electrode plates effects transfer of the resin and fiber particles to the rotating drum for deposition on the forming surface in a pattern corresponding to the pattern electrode beneath the forming surface. In this manner, the fiber and resin particles are said to be deposited with maximum intermingling to form a coherent mat. It is stated at column 3, lines 26–27 of the patent that multiple fiber feeds, in the form of spools of yarn, may be fed to the system.

U.S. Pat. No. 3,128,507 to L. E. Pearson relates to a method of making a nonwoven web from two or more tows of filaments. One tow of fibers is fiberized at a first station, which may, for example, comprise a pair of opposedly rotating bladed cylinders, following which the fibers from the first station are transported onto another tow in a randon fashion. The second tow then enters a second station which again may be defined by opposedly or co-directionally rotating bladed cylinders, wherein the first tow fibers are subjected to secondary fiberization concurrently with fiberization of the second tow. The fiberized fibers of the first and second tows then pass from the second station to a laydown surface such as an endless belt conveyor. The patent discloses that the respective tows can be, and preferably are, different as to at least one feature, such as length, color, size, response to heat or other features.

U.S. Pat. No. 3,753,271 to D. M. McBean describes a random web forming machine wherein a fiberizer comprising a toothed cylinder is disposed in a housing to receive a sheet or mat of fibrous raw stock which is fiberized and subsequent thereto delivered to a venturi passage for flow therethrough under negative pressure differential onto a foraminous forming surface. The fiberizer and forming surface are disposed in a housing defining a continous flow system, whereby air flow through the forming surface from the venturi is recirculated through the housing to the mouth of the venturi. The forming surface is an endless belt type, mounted so that the direction of travel of the belt can be adjusted angularly with respect to the venturi discharge duct outlet opening. In such manner differing widths of webs can be produced by varying the direction of travel of the forming surface belt with reference to the discharge opening of the duct.

U.S. Pat. No. 3,781,150 describes a system for producing multilayer fibrous mats, wherein the layers are integrally held together by interfiber bonds at their interfaces under the influence of suction air. A source of pulp fibers is introduced into the system from a shredding unit, it undispersed form, to a disintegrator which produces finely separated short-length fibers. The disintegrator comprises a cylindrical housing containing an axial array of blade runners superimposed upon one another at random angles to form a blade assembly. The blade assembly is disposed in a subhousing formed by a perforated cylindrical wall, through which the disintegrated finely separated short-length fibers are distributed. Air flows into and through the housing by means of an elongate slit communicating with the atmosphere and extending axially on opposite sides of the casing, in association with air intake and damper assemblies at the upper end of the casing. An endless belt foraminous forming surface is disposed beneath the casing to receive fibers passing through the perforated wall under the influence of air flow through the casing and forming surface, to suction boxes disposed beneath the forming surface. A defibrator is associated with the disintegrator to produce long fibers, the defibrator extending substantially the full length of the disintegrator unit. A long-fiber forming lap is defibrated by a toothed wire into finely separated individual fibers which pass through a funnel-like passage axially communicating with a lower portion of the casing, for flow therethrough and deposition on the forming surface. The forming surface is translated in a direction such that long fibers are first deposited on the forming surface followed by fine fibers, and optionally gain by long fibers. The long fibers in this system thus are not produced in the same fiberizer unit as the short fibers, but pass through separate channels in the casing for sequential deposition on the forming surface.

In U.S. Pat. No. 4,268,340 to H. G. Fitzgerald, et al., there is disclosed an apparatus for forming an absorbent web comprising a matrix of hydrophilic and hydrophobic materials derived as wastes in the manufacture of disposable absorbent articles, whereby the waste materials may be recycled and utilized for forming such articles. Alternatively, the feed materials may be virgin hydrophobic and hydrophilic materials. In either event, the feed materials are conveyed to a shredder, comprising a plurality of axially spaced blades mounted on a common shaft, each of the blades having projecting teeth spaced around the periphery of the blades. The resulting shredded material then is air-entrained and conveyed to a cyclone separator, wherein heavier shredded particles are collected and conveyed to a fiberizer, which may be a pin cylinder. The fiberizer reduces the particles passing thereto into a finer size as particles, shreds and fibers, including hydrophilic and hydrophobic material, which then are drawn, via air-entrainment, onto a foraminous forming surface, to provide a nonwoven web comprising such hydrophilic and hydrophobic materials.

U.S. Pat. No. 4,018,646 to A. P. Ruffo, et al., discloses a system which is similar to that of U.S. Pat. No. 3,963,392 to P. K. Goyal, except that only a single pair of fiberizing drums is employed, each associated with the feed of a single component, illustratively described as being pulp on one side and staple fibers on another. A vertically movable baffle is translatable between the respective fiberizing drums to vary the degree of mixing cross-over of the components and produce a variety of nonwoven fabrics, such as a web having a predominance of one fiber type at one of its major faces and a predominance of the other fiber type at the other of its major faces, with a transition between the respective faces in which the predominance of fibers decreases uniformly away from the face at which they predominate. Alternatively, it is possible to form nonwoven webs characterized by essentially discrete layers of the respective components, corresponding to the operation of the apparatus when the central baffle is downwardly most extended.

U.S. Pat. No. 3,952,124 to F. K. Mesek discloses the utilization of dual systems, each of the type as shown in Ruffo, it al., U.S. Pat. No. 4,018,646 to produce a composite multi-layer web therefrom. The dual fiberizer drum assembly having a baffle plate disposed therebetween is utilized to form a first web portion having one face enriched in long fibers and the other enriched in short fibers with the concentration of long and short fibers decreasing substantially uniformly from the enriched faces to form a transition region therein. Similar apparatus is employed to form a second web portion which preferably is the same as the first portion and is bonded thereto in mirror image (back-to-back) relationship, so that the long fiber enriched faces are outwardly disposed to provide substantial structural integrity to the formed web article.

As shown by the foregoing, the art has proposed numerous apparatus and methods for forming integral laid fibrous webs from multiple fiberizable components. These components are either completely intermixed or comingled with one another to produce a substantially homogemeous composition throughout the laid article, or the separate components are laid down in a sequential or partially mixed manner to provide laid fibrous webs with thickness layers of different composition.

SUMMARY OF THE INVENTION

One aspect of the present invention relates to an apparatus for forming an integral laid fibrous web from two or more fiberizable components. The fibrous web has multiple, demarcated, generally discrete homogeneous compositional zones therein. The apparatus includes: a housing having in its outer surface (i) inlet means for introducing fiberizable materials into said housing and (ii) exit means, which is spaced from and is generally laterally coextensive with said inlet means for discharging fiberized materials from said housing; a translatable body positioned in the housing for movement therein and having a plurality of blades on its outer surface, with the outer surface of the translatable body and the housing having a space therebetween wherein the blades travel during the movement of the translatable body; means for feeding a first fiberizable component to the inlet means; means for feeding at least a second fiberizable component to the inlet means in an arrangement that at least partially laterally isolates the second fiberizable component from the first fiberizable component; a movable and translatable foraminous forming surface positioned for receipt of the fiberized materials discharged from the housing through the discharge and drive means for moving the translatable body in the housing; wherein the blades and the space between the translatable body and the housing are dimensionally sized, and the drive means for the translatable body is capacitively sized, to substantially avoid lateral interdispersion between fibers of the first and second components in the housing, whereby the fiberized components discharged from the housing onto the foraminous forming surface during the movement thereof are laid thereon to form generally discrete homogeneous compositional zones of an integral laid fibrous web.

In another aspect of the invention, the housing and translatable body each have cylindrical geometries, with the apparatus comprising: a cylindrical housing having in its outer cylindrical surface (i) longitudinally extending inlet means for introducing of fiberizable materials into the housing and (ii) a longitudinally extending discharge means generally longitudinally coextensive with and circumferentially spaced from said inlet means, for discharging fiberized materials from the housing; a rotatable cylindrical body concentrically positioned in the housing for rotation therein about its cylindrical axis and having a plurality of radially extending, circumferentially spaced-apart blades on its outer cylindrical surface, such blades having a radial extent defining a first radial dimension, with the cylindrical body and cylindrical housing having an annular space therebetween defining a second radial dimension not substantially larger than the first radial dimension; means for feeding a first fiberizable component to the inlet means; means for feeding at least a second fiberizable component to the inlet means in an arrangement that at least partially axially isolates the second fiberizable component from the first fiberizable component; a traslatable foraminous forming surface positioned for receipt of the fiberized materials discharged from the cylindrical housing through the discharge slot; and means for rotating the rotatable cylindrical body in said cylindrical housing, at a rotational speed sufficient to substantially avoid axial or longitudinal interdispersion between the first and second components therein, whereby the fiberized components discharged from the cylindrical housing onto the foraminous forming surface during translation thereof are laid thereon in generally discrete, homogeneous compositional zones constituted within an integral laid fibrous web.

In a particular aspect of the invention, the inlet means for introducing fiberizable materials into the housing is a single longitudinal inlet slot, with the aforementioned means for feeding a first fiberizable component to the inlet means, serving to feed such component to a first longitudinal segment of the single slot, and with the aforementioned means for feeding the second fiberizable component to the inlet means, serving to feed same to the second longitudinal segment of the inlet slot that is distinct from the first longitudinal segment thereof.

In another apparatus aspect of the invention, the inlet slots comprise discrete slots, with the first fiberizable component fed by the feeding means to the first inlet slot, and the second fiberizable component being fed by feeding means to a second inlet slot distinct from the first inlet slot.

Another aspect of the invention relates to a method for forming an integral laid fibrous web from multiple fiberizable components. The fibrous web is characterized by demarcated generally discrete homogeneous compositional zones therein, and the method includes the steps of: providing a housing having in its outer surface (i) inlet means for introduction of fiberizable materials into the housing and (ii) discharge means spaced from and generally laterally coextensive with the inlet means, for discharging fiberized materials from the housing; positioning a translatable body in the housing for movement therein and providing a plurality of blades on its outer surface, with the outer surface of the translatable body and the housing having a space therebetween wherein the blades travel during movement of the translatable body; positioning a translatable foraminous forming surface for receipt of the fiberized materials discharged from the housing through the discharge slot; feeding a first fiberizable component to the inlet means; feeding at least a second fiberizable component to the inlet means in an arrangement that at least partially laterally isolates the second fiberizable component from the first fiberizable component; translating the foraminous forming surface; moving the translatable body in the housing at a translational speed sufficient to substantially avoid lateral interdispersion between the fiber the first and second component therein; and discharging the fiberized materials from the housing through the discharge means onto the foraminous forming surface during movement thereof, whereby the fiberized components discharged from the housing onto the foraminous forming surface during movement thereof are laid thereon to form generally discrete homogeneous compositional zones of an integral laid fibrous web.

In yet another aspect of the invention, the housing and translatable body have a cylindrical geometric shape, and the method of the invention comprises the steps of: providing a cylindrical housing having in its outer cylindrical surface (i) longitudinally (axiallly) extending inlet means for introduction of fiberizable materials into the housing and (ii) a longitudinally (axially) extending discharge means generally longitudinally (axially) coextensive with the circumferentially spaced from the inlet means, for discharging fiberized materials from the housing; concentrically positioning a rotatable cylindrical body in the housing for rotation therein about its cylindrical axis and having a plurality of radially extending, circumferentially spaced apart blades on its outer cylindrical surface, the blades having a radial extent defining a first radial dimension, with the cylindrical body and the cylindrical housing having an annular space therebetween defining a second radial dimension not substantially larger than the first radial dimension; positioning a translatable foraminous forming surface for receipt of the fiberized materials discharged from the cylindrical housing through the discharge slot; feeding a first fiberizable component to the inlet means; feeding at least a second fiberizable component to the inlet means in an arrangement that at least partially axially isolates the second fiberizable component from the first fiberizable component; translating the foraminous forming surface; rotating the rotatable cylindrical body in the cylindrical housing at a rotational speed sufficient to substantially avoid longitudinal (axial) interdispersion between the fibers of first and second fiberizable components therein; and discharging fiberized materials from the cylindrical housing through the discharge slot onto the foraminous forming surface during translation thereof, whereby the fiberized components discharged from the cylindrical housing onto the foraminous forming surface during translation thereof are laid thereon to form generally discrete homogeneous compositional zones constituted within the integral laid fibrous web.

Analogous to the specific form of the inlet slot(s) as described above in connection with the apparatus aspects of the invention, the method as respective preferred embodiments wherein, in one embodiment, the first and second fiberizable components are fed to first and second distinct longitudinal segments of a single inlet slot; in another preferred embodiment, separate longitudinally extending slots, circuferentially spaced-apart from one another, are utilized for introduction of the respective first and second components into the casing for fiberization therein.

In an article aspect the present invention relates to an integral laid fibrous web having top and bottom surfaces defining the thickness of the web, with at least two demarcated, generally discrete laterally extending contiguous zones therein of differing composition, each said zone having a substantially homogeneous composition throughout the thickness of the web associated with such zone.

Generally, the present invention provides improved apparatus and method for forming an integral laid fibrous web from multiple fiberizable components characterized by generally discrete, homogeneous compositional zones therein.

The apparatus and method of the invention are capable of producing an integral fibrous web wherein the boundaries between adjacent compositional zones are sharply defined.

The present invention also provides an integral laid fibrous web with multiple laterally extending zones of differing composition, wherein each zone has a substantially homogeneous composition throughout the thickness of the web.

Compared to conventional fibrous webs comprised of layers, the fibrous web of the invention can have greater resistance to separation at the interface between different components, greater strength, and greater resistance to delamination. In addition, the interfacial region, which demarcates a connective border between the components of the fibrous web of the invention, can be selectively controlled to adjust the degree of mixture of the component fibers in the interface region.

Other aspects and advantages of the present invention will be more fully apparent from the ensuing disclosure and appended claims.

BRIEF DESCRIPTION OF THE DRAWINGS

The features and elements of the present invention will be more fully appreciated with respect to the appended drawings, wherein.

DETAILED DESCRIPTION OF THE PREFERRED EMBODIMENTS

Figure 1:
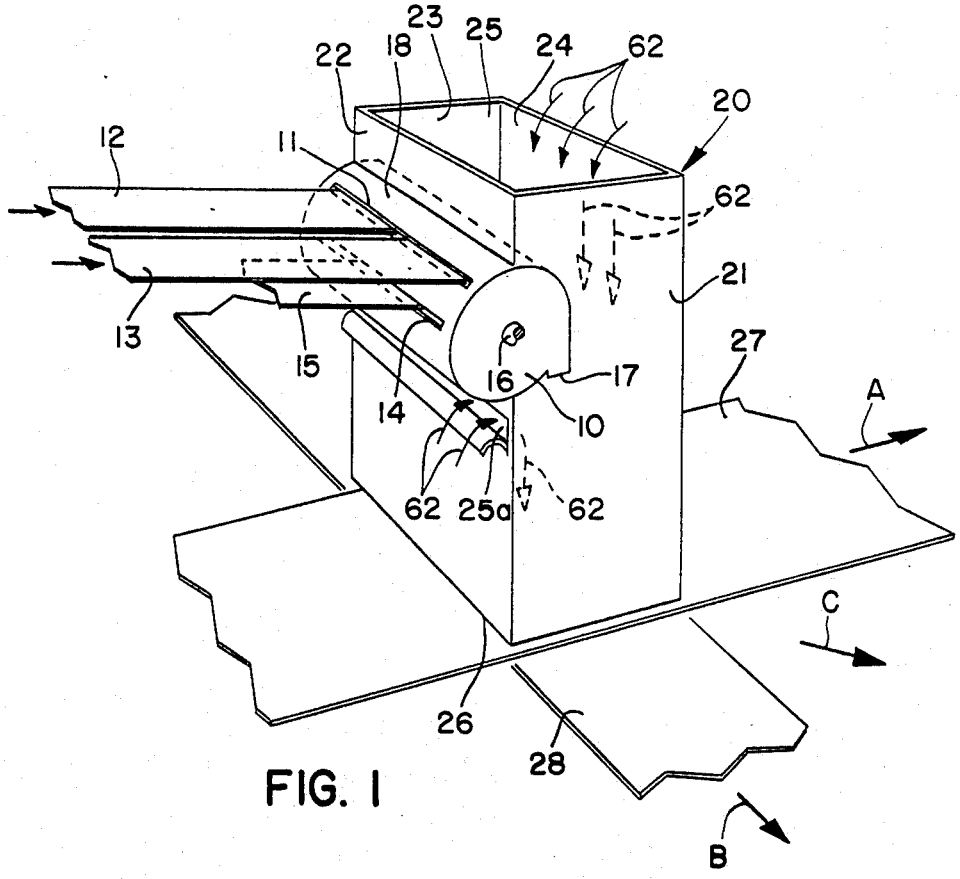
FIG. 1 is a simplified perspective view of the apparatus of the present invention, representatively showing three different directions for translation of the foraminous forming surface, relative to the longitudinal axis of the rotatable cylindrical body, in the cylindrical housing defining the fiberization chamber.

Referring now to FIG. 1, there is shown a simplified perspective view of an apparatus for forming an integral laid fibrous web from multiple fiberizable components. This web is characterized by generally discrete, homogeneous compositional zones therein. In the illustrated apparatus, a cylindrical housing 10 has in its outer cylindrical surface 18 longitudinally extending inlet means, such as an opening or slot 11 and optional slot 14, for introduction of fiberizable materials into the housing. The housing also features a longitudinally extending exit means, such as an opening or slot 17, which is generally longitudinally coextensive with and circumferentially spaced from the inlet slot(s), for discharge of fiberized materials from the housing.

The discharge outlet slot should be substantially free of obstructions, such as screens and baffles. Obstructions at the discharge slot can restrict the exit and deflect the trajectories of fibers from the housing to cause undesired intermixing of the different fibers. In addition, the presence of obstructions can undesirably recirculate the fibers through the annulus with the rotor and cause further intermixing.

In one embodiment of the invention, as generally shown in FIG. 1, slot 14 is deleted and only slot 11 is employed to feed fiberized materials into the housing. As shown, slot 11 is being fed with separate, generally parallel aligned sheets of fiberizable materials, 12 and 13. These respective fiberizable sheets may be of staple fibers, pulp, or other cellulosic material, or polymeric, fabric or any other fiberizable materials which suitably may be processed for formation of a nonwoven web, or may be utilized as an adjuvant, additive or dispersant in the web composition. The respective sheets 12 and 13 may be fed from a suitable feeding means (not shown) such as fiber sheet rolls utilized in conjunction with endless conveyor belts and/or guide rolls, to translate the respective fiber sheets into the feed slot(s) of the housing 10.

It is a central feature of the present invention that the respective, e.g. first and second, fiberizable components, such as sheets 12 and 13 in FIG. 1, be fed to an inlet slot in the cylindrical housing, such that the respective fiberizable components are at least partially laterally isolated from each other. In application to the FIG. 1 embodiment, if only inlet slot 11 is used, as a single longitudinally extending inlet slot for ingress of fiberizable materials into the housing 10, the criterion that the first and second fiberizable components are at least partially laterally isolated, means that the respective conponents are fed into the slot so that there is at most only a partial lateral, edge-to edge overlap, or, in terms of the cylindrical housing geometry shown, a partial axial overlap therebetween. The lateral direction (or, in the FIG. 1 system, the axial direction) is the direction transverse to the direction of feed of the fiberizable materials into the housing. Preferably, as shown in FIG. 1, there is no axial overlap of the fiberizable materials, i.e., the first fiberizable component is fed to a first longitudinal segment of the inlet slot and the second fiberizable component is fed to a second longitudinal segment of the inlet slot, distinct from the first longitudinal segment thereof.

In an alternative embodiment of the invention, the outer cylindrical surface 18 of the cylindrical housing 10 may have longitudinal extending inlet slots 11 and 14 therein, circumferentially spaced-apart from one another, with a first fiberizable component being introduced into one slot and a second fiberizable component being introduced into the other slot. Thus, a single sheet of fiberizable material could be fed into slot 11 as the first component; alternatively, as shown the twin sheets 12, 13 may be fed into the slot 11, concurrently with the feeding of another fiberizable conponent 15 into inlet slot 14.

In the embodiment wherein plural, longitudinally-extending slots are employed to provide the inlet means into the interior of housing 10, the terms "at least partially laterally isolated" or "at least partially axially isolated," used in reference to the respective fiberizable components, means that the respective fiberizable components are not laterally (axially) coextensive in length at the housing outer surface, i.e., there is no complete lateral (axial) overlap of the fiberizable materials fed to the respective slots. This is shown in the alternative embodiment illustrated in FIG. 1, wherein slots 11 and 14 are disposed on the housing's outer cylindrical surface 18, but wherein the width or transverse extent of the laid web, measured along the axial direction at the cylinder's outer surface, is not wider than the width of the sheet(s) fed to the upper inlet slot 11. Stated another way, the fact that the respective fiberizable components are at least partially laterally (axially) isolated from one another means that there is at most only a partial lateral (axial) overlap between them (note that the fiberizable sheet(s) introduced by slot 11 into the cylindrical housing 10 overlaps the fiberizable material 15 introduced into the cylinder in slot 14 only at the central portion of the top sheet(s), with the marginal portions of the top sheet(s) being "axially isolated" from the lower sheet).

In further aspects of the invention, additive materials, such as solid particulates or liquids, may be dispersed or otherwise incorporated into the formed web. For example, the method and apparatus of the invention may be employed to distribute superabsorbent particles within the web. A representative technique for accomplishing this would include an appropriate sizing of slot 14 and a repositioning of the slot to a selected axial location on housing 10. The desired additive material would be introduced through slot 14, while the fiberizable components would be introduced through inlet slot 11.

As another example, a suitable liquid material could be dispersed into the interfacial region between different components. This liquid material could then react with the different fibers to produce a chemical cross-linking therebetween.

The cylindrical housing 10 contains a rotatable cylindrical body, described more fully hereinafter, which is mounted on a longitudinally extending shaft 16, whereby the rotatable cylindrical body may be rotated by suitable drive means (not shown) which may comprise electrical motor or other drive means, to effect fiberization of the fiberizable materials introduced into the slot(s) of the housing 10. The resulting fiberized material is discharged from the housing through longitudinally extending discharge slot 17 which is generally longitudinally coextensive with and circumferentially spaced from the inlet slot(s). By characterizing the discharge slot as generally laterally or longitudinally coextensive with the inlet slot(s), it is meant that the discharge slot has a lateral (longitudinal) dimension which is at least as great as the lateral (longitudinal) dimension of the slot or slot(s) which are utilized to feed fiberizable materials into the housing. Thus, in the FIG. 1 embodiment, the discharge slot 17 has a length measured along the outer cylindrical surface 18 of the housing 10 which is equal to the length of inlet slot 11.

Positioned beneath the cylindrical housing 10 to receive fiberized materials discharged therefrom through the discharge slot 17 is a translatable foraminous forming surface, which may be of conventional type such as an endless belt forming screen or Fourdrinier wire surface. The forming surface may comprise the foraminous forming surface 27, which is translated in the direction shown by the Arrow A. The cylindrical axis of cylindrical housing 10 is positioned generally transversely to the direction of translation of the foraminous forming surface 27, here being perpendicular to such direction of translation.

Alternatively, the forming surface disposed to receive the fiberized materials discharged from the cylindrical housing 10 through the discharge slot 17 may comprise the foraminous forming surface 28, in place of the forming surface 27. The forming surface 28, may be of any suitable type analogous to the forming surface 27, and is translated in the direction shown by Arrow B. In such manner, the cylindrical axis of the cylindrical housing 10 is positioned in a generally unidirectional and parallel alignment with the direction of translation of the foraminous forming surface, here being generally parallel to such direction of translation.

Figure 1A:
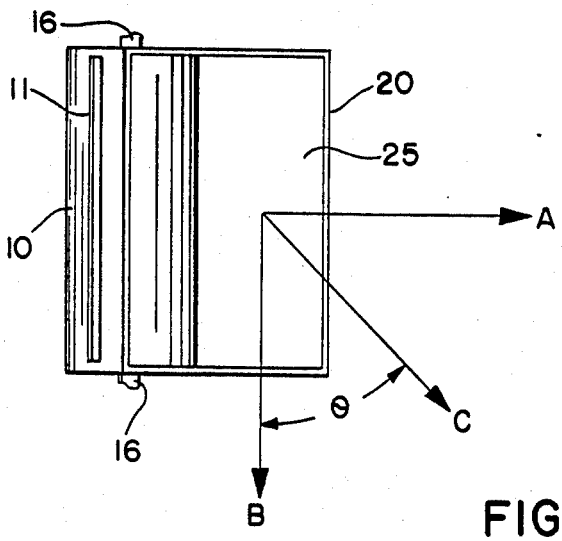
FIG. 1*a* representatively shows a top plan view of the apparatus illustrated in FIG. 1.
Figure 6:
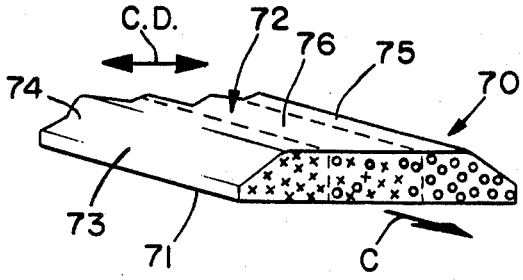
FIG. 6 representatively shows a perspective view of an end section of an integral laid fibrous web formed with the apparatus of FIG. 1 while moving the foraminous forming surface in the C-direction.

In still another configuration of the apparatus of the invention, the movable forming surface is translated in a diagonal direction shown in FIGS. 1 and 1*a* by the Arrow C. This diagonal orientation of the forming surface movement direction relative to the cylindrical axis of housing 10 corresponds to the intermediate arrangements between the generally "perpendicular" and generally "parallel" orientations described above. As representatively shown in FIG. 1a, the amount of diagonal or angular offset, "theta", can be selectively controlled to adjust the amount of mixture and overlap between the fibers of the two components within interface region 76 (FIG. 6). The cross-directional width of the interface region between the two components can be increased or decreased, as desired, by decreasing or increasing the angle, "theta", measured between the movement direction of the forming surface and the axial direction of the cylindrical housing. This adjustment technique can be employed to create a substantially flat, edge-to-edge, cross-sectional profile across the CD width of the interface region of the formed web. For example, FIG. 6 representatively shows an integral laid fibrous web formed from two different materials which have been fed into housing 10 with substantially no axial overlap or separation therebetween. Interface region 76 contains a mixture of the two materials and has essentially the same basis weight as the remainder of the fibrous web.

The technique can also be employed to create a selected basis weight variation, as measured along the cross-direction (CD) of the formed web, by regulating the amount of overlap between the webs of material being fed into the housing. Increasing the amount of overlap produces an increased basis weight over a greater portion of the CD width of the formed web.

Figure 7:
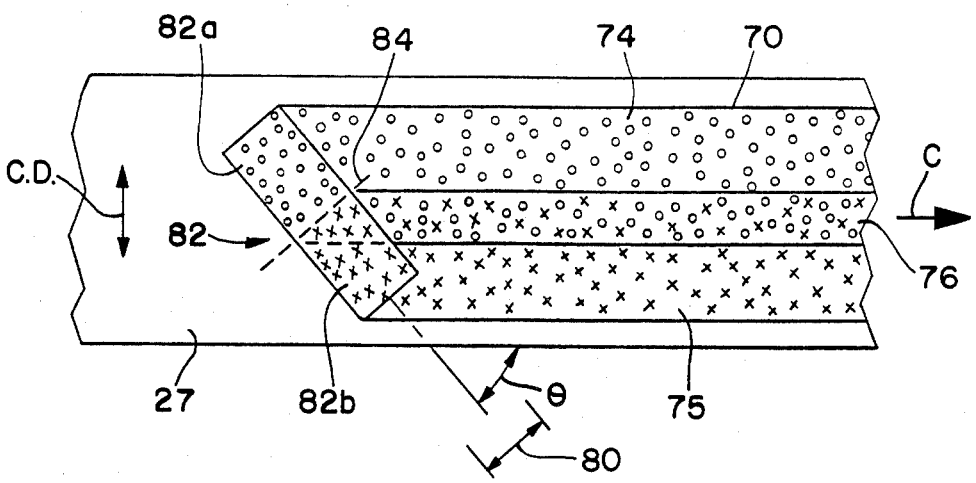
FIG. 7 representatively shows the effect of the fiber stream thickness on the interface region of the laid fibrous web.

In addition to diagonally orienting the axis of cylindrical housing 10, the CD width of interface region 76 can also be controlled by regulating the "thickness" of the stream of fibers deposited onto forming surface 27. This fiber stream thickness is the dimension of the fiber stream that is measured perpendicular to the rotor axis. FIG. 7 illustrates the relationship between the angle "theta" and the CD width of interface region 76. As "theta" increases, the width of the interface region decreases. In the illustrated embodiment, fiber stream portion 82*a* is composed of a first fiber component, fiber stream portion 82*b* is composed of a second fiber component and dotted line 84 indicates the approximate boundary between the different fiber components.

The thickness of the fiber stream can be regulated by adjusting the relative difference between the fiber stream velocity and the velocity of a merging air stream 62 passing through flow housing 20. This merging air stream moves adjacent to the fiber stream and is drawn into housing 20 through inlets 25 and 25*a*. If the fiber stream velocity is substantially equal to the merging air stream, the thickness of the fiber stream remains substantially unchanged as it moves from discharge opening 17 to forming surface 27. If the fiber stream velocity is greater than the merging air stream velocity, the thickness of the fiber stream will increase as the fiber stream moves from the discharge slot to the forming surface. The greater the difference in the relative velocities, the greater the increase in the fiber stream thickness. The difference in relative velocities, however, should not be so great that it causes undesired recirculating gas flows within the flow housing 20.

Figure 8:
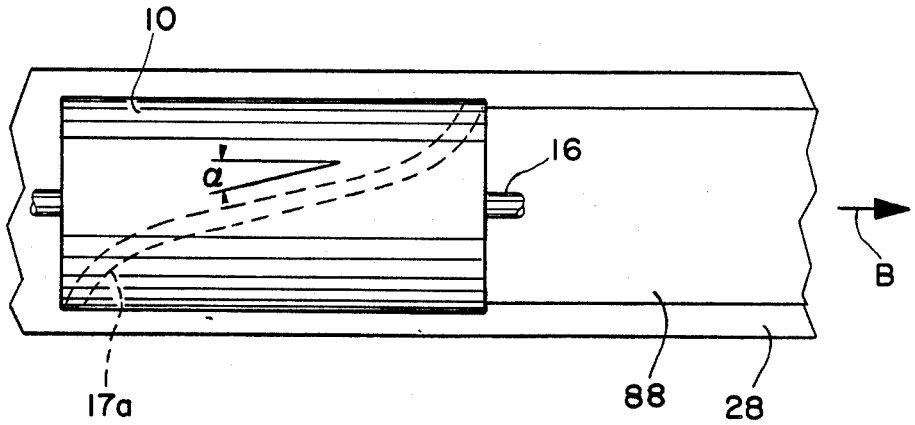
FIG. 8 representatively shows a curvilinear discharge opening formed in a fiberizer housing.

When the invention is configured to move forming surface 28 along direction B, a laid fibrous web having a substantially flat, edge-to-edge cross-sectional profile across the CD width of the formed web can be produced by employing a discharge slot that is angularly offset relative to the axis of the fiberizer rotor, as illustrated in FIG. 8. Instead of being essentially parallel to rotor axis 16, the discharge slot is oriented at an offset skewed angle "alpha" relative to the rotor axis. As a result, the discharge opening has a curvilinear configuration that is approximately helical in form. This curvilinear discharte slot duct opening 17a is oriented to open toward along a direction that generally faces toward forming surface 28, and is capable of directing a fibers stream to form a fibrous web 88 which has a CD width approximately equal to the diameter of the fiberizer. The precise CD profile of the formed web can be varied and will depend upon the particular flow velocities of the fiber stream and the particular curvilinear shape of the discharge slot.

The configurations in which the movement of the forming surface is aligned along directions B or C are particularly advantageous for producing high basis weight fibrous webs. The basis weight of the formed fibrous web can be increased by increasing the axial length of the fiberizer rotor portion of the invention. Increasing the length of the fiberizer rotor increases the total throughput of material onto the forming surface, but does not increase the throughput of material per unit length of axial rotor length. Eliminating the need to increase the throughput of material per unit length of rotor length reduces the possibility of incomplete fiberization of the material within housing 10.

The amount or degree of merging and blending in the interface region of the formed web can also be adjusted to control the interfacial or boundary resistance between the different fibrous components of the web. In particular, increasing the degree of mixing of the different fibers in the interface region can reduce the boundary resistance between the components. The term "boundary resistance" is meant to encompass the differences in physical and chemical properties between the components which would affect the absorptive characteristics of the fibrous web. Such physical and chemical properties would include, for example, high and low surface energy properties, and pore size gradients.

The FIG. 1 apparatus shows a representative means for combining the fiberized components discharged from the cylindrical housing 10 through the discharge slot 17, with a merging air stream, and channeling the merged air and fibers stream onto the foraminous forming surface, without substantial mixing of fiberized components transverse to the direction of flow of the stream. Such means comprise the flow housing 20 bounded by the walls 21, 22, 23 and 24, and presenting a generally rectangular cross-section when viewed in plan view at the air inlet face 25, viewing downwardly toward the fibers outlet face 26. Thus, the flow housing 20 in its interior defines a flow channel in fibers flow communication with the discharge slot 17 of the cylindrical housing 10. Vacuum box or other suction means may be disposed beneath the forming surface 27 or 28 in proximity to the outlet face 26 of the flow housing, whereby merging air is flowed into the flow housing 20 at the inlet face 25 to merge and combine with the fibers discharged from slot 17. It is important that the volumetric air flow through the flow housing be characterized by a substantially uniform velocity profile, of the air flow across the inlet and outlet faces 25 and 26, respectively. This helps insure that substantially no longitudinal interdispersion occurs between the respective discharged fiberized materials prior to their deposition on the forming surface.

In addition, air may be introduced into a selected portion of housing 10, such as the top of the housing, in a manner conventionally employed in the art to provide a supplemental gaseous transporting medium therein. In a particular embodiment of the invention, this supplemental gaseous transporting medium is forced into housing 10 along a path which is generally tangential to the surface of the fiberizer rotor and co-directional with the movement of the rotor surface within the housing.

Figure 2:
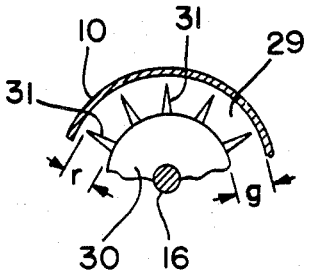
FIG. 2 is a partial sectional elevational view of the rotatable cylindrical body disposed in the cylindrical housing of the fiberization chamber.

FIG. 2 illustrates a sectional, elevation view of the portion of the cylindrical housing 10 showing the interior elements thereof. The cylindrical housing 10 has disposed therein a rotatable cylindrical body 30 concentrically positioned in the housing for rotation about its cylindrical axis, by virtue of the concentrically mounted drive shaft 16. A plurality of radially extending, circumferentially spaced-apart blades 31 are positioned on the outer cylindrical surface of the rotatable body 30. These blades have a radial extent defining a first radial dimension denoted as "r" in the drawing, with cylindrical body 30 and the cylindrical housing 10 having an annular space 29 therebetween defining a second radial dimension, denoted in FIG. 2 as "g", which is not substantially larger than the first radial dimension, "r".

In practice, the first radial dimension, r, which is the height of the radially extending blades, measured along a radius of the cylindrical casing from a point on the surface of the rotatable body 30, may be on the order of one inch.

The second radial dimension, g, which is the annular cylindrical wall-to-cylindrical surface distance, as measured therebetween along a radius of the cylindrical housing, may be on the order of 1.125 inch. In preferred practice the ratio of the first radial dimension, r, to the second radial dimension, g, is in the range of from about 0.7 to 0.98, and most preferably in the range of from about 0.8 to 0.95.

The bladed, rotatable cylindrical body 30 may suitably have peripheral teeth arranged in bands extending transversely and around the rotor axis. The tooth pattern in each band can extend circumferentially in an approximately sinusoidal wave shape on the rotor periphery to provide impact distributed in simple harmonic motion along the cross-direction impact line of the sheet fed through the infeed slot into the casing.

The rotatable cylindrical body 30 is mounted on a suitable drive shaft 16, and may be driven by electircal motor or other drive means to provide a peripheral speed at its outer cylindrical surface which is sufficient to produce the fibers of the first and second components as they move through in the annular chamber in the cylindrical housing. In such manner, the fiberized components discharged from the cylindrical housing 10 onto the foraminous forming surface 27 or 28 during translation thereof are laid thereon in generally discrete homogeneous compositional zones constituted within an integral laid web. For the aforementioned illustrative embodiment wherein r is one inch and g is 1.125 inch, the peripheral surface speed is at least 6,000 fpm, and more generally, peripheral surface speeds on the order of from about 16,000 to 30,000 fpm have been found suitable in the broad pracitice of the present invention.

In the operation of the apparatus as shown in FIGS. 1–2, the fiberizable materials, such as a hardwood pulp sheet 12 and a softwood pulp sheet 13, or an upper single hardwood pulp sheet in slot 11 and a lower softwood pulp sheet in slot 14, are introduced into the cylindrical housing, wherein the bladed cylindrical body 30 is rotated at suitable speed, consistent with the dimensions r and q, to fiberize the respective components in the housing, within the annular space. Pulp sheets 12 and 13 are fed through their respective input slots with a relative arrangement in which the pulp sheets are at least partially laterally isolated from each other. In addition, any unused feed slots are plugged or otherwise covered to prevent the blowing of fibers out through the slots. The fiberized components discharged from the cylindrical housing onto the forming surface 27 or 28 during translation thereof are laid on the forming surface in generally discrete homogeneous compositional zones of the laid nonwoven fibrous web. It will be appreciated that the extent of longitudinal interdispersion of fibers in the annular space for the housing 10, under the influence of fiberizing blade elements 31, will be a function of the rotational speed, and dimensions r and g, as well as the fiberizability of the fibrous components introduced into the casing. Accordingly, one of the ordinary skill may, without undue experimentation, employ a few trial runs to determine the extent of lateral (axial) dispersion in the web forming system and adjust same so as to minimize lateral (axial) interdispersion therein to a desired level.

Upon fiberization of the respective components introduced into the housing 10, the resulting discrete fibers are circumferentially translated to the discharge slot 17 and discharged into the flow housing 20, to be merged with the air stream entering at inlet face 25 and 25*a*, as previously described. A suitable vacuum box or other suction means (not shown) may be disposed beneath the forming surface 27 or 28 to impart a negative pressure on the surface to draw the air component of the air-fibers stream therethrough, leaving the fibers deposited on the forming surface. Inasmuch as the fiberizable materials introduced into the housing 10 are fiberized therein without significant longitudinal (axial) mixing within the annular space thereof, the effluent or discharge stream of fiberized materials leaving the housing 10 through slot 17 has a composition along the axial direction which is essentially commensurate and in a substantially one-to-one correspondence with the compositions of the fiberizable components at the inlet slot(s) of the housing 10. Thus, it is possible to lay down on the forming surface a fibrous web which has highly discrete compositional zones contiguous to one another, as described more fully hereinafter.

Figure 3:
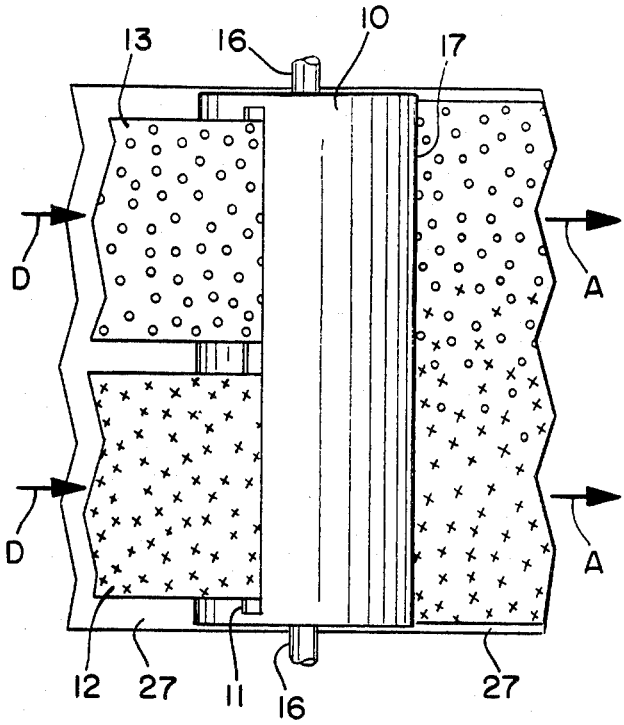
FIG. 3 is a partial plan view of the cylindrical housing of FIG. 1.

FIG. 3 illustrates a top plan view of a portion of the FIG. 1 apparatus, comprising the cylindrical housing 10 and the drive shaft 16. The FIG. 3 embodiment utilizes feed of two materials, sheets 12 and 13 into the housing through slot 11, in the direction shown by Arrows D. The resulting fiberized materials then are discharged downwardly from the cylindrical housing 10 through discharge slot 17 onto the foraminous forming surface 27 being translated in the direction denoted by Arrows A.

Figure 4:
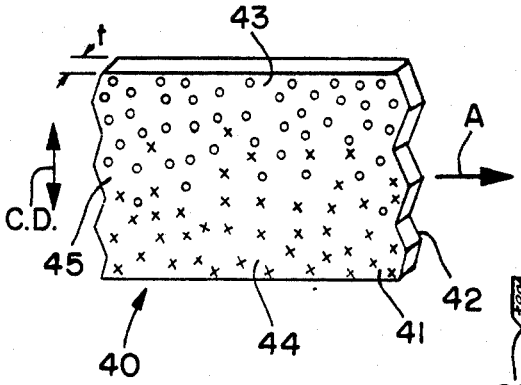
FIG. 4 is a plan view of the section of the integral laid fibrous web, produced by means of the apparatus of FIG. 1, utilizing the foraminous forming surface 27.

FIG. 4 is a perspective view of a laid fibrous web 40 formed from sheets 12 and 13 by the apparatus as shown in FIG. 3. The fibrous web 40 has a top surface 41 and a bottom surface 42 defining the thickness of the web, as the distance therebetween, denoted "t". This integral laid fibrous web has two generally discrete, laterally extending contiguous zones 43 and 44 therein of differing composition, zone 44 corresponding compositionally to sheet 12, and zone 43 corresponding compositionally to sheet 13 and a very small interlayer or boundary area 45 therebetween corresponding to a mixed composition derived from the materials of sheets 12 and 13, respectively. As used herein in reference to the compositional zones of the laid fibrous web, the term laterally extending means that such zones extend partially or fully across the web top and bottom surfaces. Thus, each of the contiguous side-by-side zones 43 and 44 has a substantially homogeous composition throughout the thickness of the web associated therewith, i.e., the respective zones are generally discrete and compositionally homogeneous, with a comparatively sharp boundary at 45.

Figure 5:
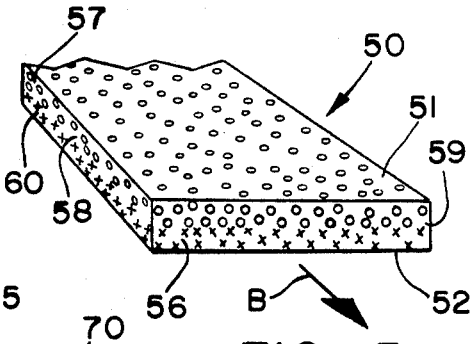
FIG. 5 is a perspective view of an end section of an integral laid fibrous web formed by the apparatus of FIG. 1, utilizing the foraminous forming surface 28.

FIG. 5 shows a perspective view of the end segment of another fibrous web laid using the apparatus of FIG. 1, but with forming surface 28 as the sole laydown surface for the web. Again, the web is formed by parallel fed sheets 12 and 13, but with the forming surface 28 being translated in a direction generally parallel to the axis of the cylindrical housing 10. Thus, Arrow B is shown in FIG. 5 for reference as the direction of translation of the forming surface on which the fibrous web segment shown has been formed. The fibrous web 50 has a top surface 51, a bottom surface 52, an end surface 56, and side surfaces 58. This web has sequential integral thickness layers, including a top layer 57 corresponding compositionally to sheet 13, a bottom layer 60 corresponding compositionally to sheet 12 and a transitional zone 59 of mixed composition, insofar as the concentrations of the respective materials of sheets 12 and 13 therein are concerned. Again, the boundary demarcated by transition zone 59 is comparatively small in reference to the thicknesses of the homogeneous constituent layers 57 and 60.

FIG. 6 representatively shows a perspective view of the end segment of another fibrous web laid employing the apparatus illustrated in FIG. 1, but moving the forming surface along the diagonal direction C. Sheets 12 and 13 are parallel fed into slot 11, and the fibrous formed web 70 has a top surface 72, a bottom surface 71 and side surfaces 73. The formed web has two generally discrete, laterally extending zones 74 and 75 having different compositions, and also has an interfacial zone or region 76 located therebetween. This interfacial zone is composed of fibers of both components which have been mixed and intermingled together. The edges of the laid fibrous web can have a lower basis weight than the remaining central portion of the web. The CD width of the lower basis edge portions will depend upon the diagonal orientation angle, "theta", and the "thichness" of the fiber stream being deposited onto the forming surface.

The multicomponent fibrous webs produced by the apparatus and method of the present invention may usefully be employed as absorbent articles in applications such as sanitary napkins or disposable diapers, as well as any other application area for fibrous webs wherein different homogeneous conpositional zones are useful.

Although illustrative embodiments of the present invention have been shown and described herein, it will be appreciated that other embodiments, modifications and variants are possible, and all such apparent embodiments, modifications and variants are to be regarded as being within the spirit and scope of the present invention.

What is claimed is:

1. An apparatus for forming an integral laid fibrous web having multiple compositional therein, comprising:

a cylindrical housing having in its outer cylindrical surface (i) longitudinally extending inlet means for introduction of fiberizable materials into said housing, said inlet means including a first inlet slot and a second inlet slot, and (ii) a longitudinally extending exit means generally longitudinally coextensive with and circumferentially spaced from said inlet means, for discharge of fiberized materials from said housing;

a rotatable cylindrical body concentrically positioned in said housing for rotation therewith about its cylindrical axis and having a plurality of radially extending circumferentially spaced-apart blades on its outer cylindrical surface, said blades having a radial extent defining a first radial dimension, with said cylindrical body and cylindrical housing having an annular space therebetween defining a second radial dimension not substantially larger than said first radial dimension;

means for feeding a first fiberizable component to said first inlet slot;

means for feeding a second fiberizable component to said second inlet slot with said second fiberizable component positioned at least partially axially isolated from said first fiberizable component;

a translatable foraminous forming surface positioned for receipt of the fiberized materials discharged from said cylindrical housing through said exit means; and drive means for rotating said rotatable cylindrical body in said cylindrical housing, at a rotational speed sufficient to substantially avoid lateral, axial interdispersion between said first and second components therein, whereby the fiberized components discharged from said cylindrical housing onto said foraminous forming surface during translation thereof are laid thereon to form generally discrete homogenous compositional zones contituted within the integral laid fibrous web.

2. Apparatus according to claim 1, further comprising means for combining the fiberized components discharged from the housing through said exit means with a merging air stream to yield an air-fibers stream, and for channeling said air-fibers stream onto said foraminous forming surface without substantial mixing thereof transverse to the direction of flow and said stream.

3. Apparatus according to claim 2, wherein said combining means comprises a flow housing the interior of which defines a flow channel in fibers flow communication with said discharge slot of said cylindrical housing.

4. Apparatus according to claim 1, wherein a single, longitudinally extending inlet slot comprises said inlet means for introduction of fiberizable materials into said housing, wherein said first fiberizable component feeding means feed same to a first longitudinal segment of said inlet slot, and said second fiberizable component feeding means feed same to a second longitudinal segment of said inlet slot distinct from said first longitudinal segment thereof.

5. An apparatus as recited in claim 1, wherein said exit means comprises said cylindrical housing having a curvilinear discharge opening formed therethrough.

6. An apparatus as recited in claim 1, wherein said drive means is capacitively sized to provide at the outer surface of said rotatable body a peripheral speed which is about 16,000–30,000 fpm.

7. An apparatus as recited in claim 1, wherein said blades have a radial height "r", said housing and said rotatable body define an annular radial dimension "g" therebetween, and wherein the ratio of "r" to "g" is in the range of about 0.7–0.98.

8. An apparatus as recited in claim 1, wherein said ratio of "r" to "g" is in the range of about 0.8–0.95.

9. An apparatus as recited in claim 1, wherein said exit means comprises an outer surface of said housing having a skewed, approximately helical discharge slot duct opening formed therein, said discharge slot duct oriented to face generally toward said foraminous forming surface.

10. An apparatus as recited in claim 1, wherein said foraminous forming surface is constructed to be translatable in a direction generally parallel to the axis of said rotatable body to produce discrete homogeneous compositional zones in a layered configuration within said laid fibrous web.

11. An apparatus as recited in claim 1, wherein said foraminous forming surface is constructed to be translatable in a direction generally perpendicular to the axis of said rotatable body to produce within said laid fibrous web an interfacial boundary area, which is composed of a fibrous mixture of said first and second components, and which is located between a first contiguous laterally extending zone composed of fibers of said first component and a second contiguous laterally extending zone composed of fibers of said second component.

12. An apparatus as recited in claim 1, wherein said foraminous forming surface is constructed to be translatable in a direction diagonal to the axis of said rotatable body to adjust a cross-directional width of an interface region of said laid fibrous web, said interface region comprising a fibrous mixture of said first and second fiberizable components, and said interface region located between a first laterally extending zone composed of said first fiberizable component and a second laterally extending zone composed of said second fiberizable component.

13. An apparatus a recited in claim 3, further comprising means for providing a flow of said merging air steam with a substantially uniform velocity profile across an inlet face of said flow housing.

14. An apparatus as recited in claim 3, further including means for providing a fiber stream of said fiberized components at a velocity which is substantially equal to, or greater than the velocity of said merging air stream, but not so great as to cause undesired recirculating gas flows within said flow housing.

15. An apparatus as recited in claim 1, wherein said second inlet slot is circumferentially spaced from said first inlet slot and at least partially overlaps said first inlet slot along the axial dimension of said rotatable body.

16. A method for forming an integral laid fibrous web having multiple compositional zones therein, comprising the steps of:

providing a housing having in its outer surface (i) inlet means for introduction of fiberizable materials into said housing and (ii) exit means generally laterally coextensive with and translationally spaced from said inlet means, for discharging fiberized materials from said housing, said lateral dimension extending along said housing in a longitudinal direction which is transverse to the direction of introduction of said fiberizable materials into said housing;

providing a translatable body positioned in said housing for movement therein and having a plurality of blades on its outer surface, with the outer surface of said translatable body and said housing having space therebetween wherein said blades travel during movement of said translatable body;

translating a foraminous forming surface positioned for receipt of the fiberized materials discharged from the housing through said discharge means;

feeding a first fiberizable component to said inlet means;

feeding a second fiberizable component to said inlet means, at least partially laterally isloate from said first fiberizable component;

translating said translatable body in said housing at a translational speed sufficient to substantially avoid lateral dispersion between the first and second components therein; and discharging fiberized material from the housing through said exit means onto said foraminous forming surface during translation thereof, whereby the fiberized components discharged from said housing onto said foraminous forming surface during translation thereof are laid thereon to form generally discrete homogeneous compositional zones of the integral laid fibrous web.

17. A method according to claim 16, further comprising the step of combining the fiberized components discharged from said cylindrical housing through said discharge means with a merging air stream to yield an air-fibers stream, and channeling said air-fibers stream onto said foraminous forming surface without substantial mixing thereof transverse to the direction of flow of said stream.

18. A method according to claim 17, further comprising confining said air-fibers stream in a flow channel in fibers flow communication with said exit means of said cylindrical housing.

19. A method for forming an integral laid fibrous web having multiple compositional zones therein comprising the steps of:

providing a cylindrical housing having in its outer cylindrical surface (i) longitudinally extending inlet means for introduction of fiberizable materials into said housing and (ii) a longitudinally extending exit means generally longitudinally coextensive with and circumferentially spaced from said inlet means, for discharge of fiberized materials from said housing;

providing a rotatable cylindrical body concentrically positioned in the housing for rotation therein about its cylindrical axis and having a plurality of radially extending, circumferentially spaced-apart blades on its outer cylindrical surface, said blades having a radial extent defining a first radial dimension, with said cylindrical body and cylindrical housing having an annular space therebetween defining a second radial dimension not substantially larger than said first radial dimension;

translating a foraminous forming surface positioned for receipt of the fiberized materials discharged from said cylindrical housing through said discharge means;

feeding a first fiberizable component to said inlet means;

feeding a second fiberizable component to said inlet means, at least partially axially isolate from said first fiberizable component;

rotating the rotatable cylindrical body in the cylindrical housing at a rotational speed sufficient to substantially avoid lateral, axial interdispersion between the first and second components therein; and discharging fiberized materials from the cylindrical housing through said exit means onto said foraminous forming surface during movement thereof, whereby the fiberized components discharged from said cylindrical housing onto said foraminous forming surface during translation thereof are laid thereon to form generally discrete homogeneous compositional zones constituted within the integral laid fibrous web.

20. A method according to claim 19, wherein said foraminous forming surface is translated in a direction generally transverse to the cylindrical axis of said rotatable cylindrical body.

21. A method according to claim 19, wherein said foraminous forming surface is translated in a direction generally parallel with the cylindrical axis of said rotatable cylindrical body.

22. A method as recited in claim 19, wherein said foraminous forming surface is translated in a direction that is generally diagonal to the cylindrical axis of said rotatable cylindrical body.

23. A method according to claim 19, wherein a single longitudinally extending inlet slot comprises said inlet means in said cylindrical housing, the first fiberizable component is fed to a first longitudinal segment of said inlet slot and said second fiberizable component is fed to a second longitudinal segment of said inlet slot distinct from said first longitudinal segment thereof.

24. A method according to claim 19, wherein longitudinally extending, circumferentially spaced-apart inlet slots comprise said inlet means for introducing fiberizable materials into said housing, said first fiberizable component is fed to a first inlet slot and said second fiberizable component is fed to a second inlet slot.

25. A method as recited in claim 19, wherein said rotatable body is rotated to provide, at its outer surface, a peripheral speed of about 16,000–30,000 fpm.

26. A method as recited in claim 24, further comprising the steps of:

circumferentially spacing said second inlet slot from said first inlet slot; and at least partially overlapping said first and second inlet slots along the axial dimension of said rotatable cylindrical body.

* * * * *

UNITED STATES PATENT AND TRADEMARK OFFICE

CERTIFICATE OF CORRECTION

PATENT NO. : 4,767,586

DATED : August 30,1988

INVENTOR(S) : F. Radwanski et al.

It is certified that error appears in the above-identified patent and that said Letters Patent is hereby corrected as shown below:

IN THE CLAIMS:

Column 18, Claim 1, line 2, after the word "compositional", insert the word -- zones --.

Column 19, Claim 2, line 43, delete "and" and substitute therefor --of--.

IN THE SPECIFICATION:

Column 1, line 48, delete "accomodate" and substitute therefor -- accommodate --.

Column 1, line 62, delete "ktherein" and substitute therefor -- therein --.

Column 2, line 11, delete "589" and substitute therefor -- 598 --.

Column 3, line 34, delete "if" and substitute therefor -- is --.

Column 4, line 48, delete "thichness" and substitute therefor -- thickness --.

Column 4, line 68, delete "for hearth" and substitute therefor -- forehearth --.

UNITED STATES PATENT AND TRADEMARK OFFICE

CERTIFICATE OF CORRECTION

PATENT NO. : 4,767,586
DATED : August 30, 1988
INVENTOR(S) : F. Radwanski et al.

It is certified that error appears in the above-identified patent and that said Letters Patent is hereby corrected as shown below:

Column 5, line 47, delete "whicle" and substitute therefor -- while --.

Column 5, line 66, delete "randon" and substitute therefor -- random --.

Column 6, line 17, delete "continous" and substitute therefor -- continuous --.

Column 6, line 32, delete "it" and substitute therefor -- in --.

Column 7, line 40, delete "it" and substitute therefor -- et --.

Column 7, line 59, delete "homogemeous" and substitute therefor -- homogeneous --.

Column 8, line 53, delete "tras-latable" and substitute therefor -- translatable --.

Column 9, line 40, after the word "fiber" and before the word "the", insert -- of --.

Column 10, line 29, delete "circuferentially" and substitute therefor -- circumferentially --.

UNITED STATES PATENT AND TRADEMARK OFFICE

CERTIFICATE OF CORRECTION

PATENT NO. : 4,767,586

DATED : August 30, 1988

INVENTOR(S) : F. Radwanski et al.

It is certified that error appears in the above-identified patent and that said Letters Patent is hereby corrected as shown below:

Column 12, line 18, delete "conponents" and substitute therefor -- components --.

Column 12, line 40, after the word "shown" and before the word "the", insert -- , --.

Column 15, line 4, delete "discharte" and substitute therefor -- discharge --.

Column 16, line 44, delete "electircal" and substitute therefor -- electrical --.

Column 16, line 59, delete "pracitice" and substitute therefor -- practice --.

Column 16, line 67, delete "q" and substitute therefor -- g --.

Column 17, line 17, delete the word "the".

Column 18, line 4, delete "homogeous" and substitute therefor -- homogeneous --.

Column 18, line 45 - delete "thichness" and substitute therefor -- thickness --.

Signed and Sealed this

Seventeenth Day of October, 1989

*Attest:*

DONALD J. QUIGG

*Attesting Officer*

*Commissioner of Patents and Trademarks*